US007197860B2

(12) United States Patent
Hughes et al.

(10) Patent No.: US 7,197,860 B2
(45) Date of Patent: Apr. 3, 2007

(54) METHOD AND APPARATUS FOR VACUUM SEALING

(75) Inventors: Gary Lee Hughes, Sedona, AZ (US); Robert Walter Millar, Eureka, MT (US); David Robert Millar, Aliso Viejo, CA (US)

(73) Assignee: Vacnseal Holdings, LLC, Sedona, AZ (US)

( * ) Notice: Subject to any disclaimer, the term of this patent is extended or adjusted under 35 U.S.C. 154(b) by 60 days.

(21) Appl. No.: 10/990,792

(22) Filed: Nov. 17, 2004

(65) Prior Publication Data

US 2005/0102975 A1 May 19, 2005

Related U.S. Application Data

(60) Provisional application No. 60/576,980, filed on Jun. 4, 2004, provisional application No. 60/520,351, filed on Nov. 17, 2003.

(51) Int. Cl.
*B65B 31/00* (2006.01)

(52) U.S. Cl. ..... 53/510; 53/432; 99/472

(58) Field of Classification Search ..... 53/510, 53/432; 206/524.8; 220/231; 141/65; 99/472

See application file for complete search history.

(56) References Cited

U.S. PATENT DOCUMENTS 3,175,590 A 3/1965 Belknap
3,312,256 A 4/1967 Reisinger
3,353,996 A * 11/1967 Hamrick ..... 134/21
3,470,673 A 10/1969 Tipper
3,471,871 A 10/1969 Nociti et al.
3,511,020 A 5/1970 Kraft et al.
3,580,300 A 5/1971 Dunn
3,628,576 A 12/1971 Owen
3,648,740 A 3/1972 Pruitt
4,051,971 A * 10/1977 Saleri et al. ..... 215/260
4,637,061 A 1/1987 Riese
4,860,523 A 8/1989 Teteishi et al.
4,928,829 A 5/1990 Di Bernardo
5,121,590 A 6/1992 Scanlan
5,195,427 A * 3/1993 Germano ..... 99/472
5,215,445 A 6/1993 Chen
5,263,520 A 11/1993 Arai
5,267,586 A * 12/1993 Jankavaara ..... 137/565.12
5,287,680 A 2/1994 Lau
5,338,166 A 8/1994 Schultz
5,396,751 A 3/1995 Chi (Continued)

FOREIGN PATENT DOCUMENTS

DE 2628913 1/1978

(Continued)

*Primary Examiner*—Thanh K. Truong
(74) *Attorney, Agent, or Firm*—Knobbe, Martens, Olson & Bear LLP

(57) ABSTRACT

A vacuum sealing apparatus has an inlet portion and an intermediate portion. The inlet portion is adapted to couple to, or insert into, a container to be vacuum sealed. The intermediate portion connects to a vacuum source, such as an in-house vacuum system. When the vacuum source is active, air is drawn in through the inlet portion. The vacuum sealing apparatus may also have a contamination filter disposed therein that substantially impedes contaminants from entering the vacuum source. In another configuration, the vacuum sealing apparatus is self-contained and includes a dedicated vacuum source.

20 Claims, 9 Drawing Sheets

U.S. PATENT DOCUMENTS

| | | | |
|---|---|---|---|
| 5,548,944 | A | 8/1996 | Prochut et al. |
| 5,551,213 | A | 9/1996 | Koelsch et al. |
| 5,561,964 | A | 10/1996 | McIntyre et al. |
| 5,839,582 | A | 11/1998 | Strong et al. |
| 5,873,217 | A | 2/1999 | Smith |
| 6,017,195 | A | 1/2000 | Skaggs |
| 6,020,013 | A | 2/2000 | Kozma |
| 6,070,397 | A | 6/2000 | Bachhuber |
| 6,085,906 | A | 7/2000 | Lambert |
| 6,161,695 | A | 12/2000 | Nicolais |
| 6,231,236 | B1 | 5/2001 | Tilman |
| 6,256,968 | B1 | 7/2001 | Kristen |
| D451,794 | S | 12/2001 | Ichikawa |
| 6,526,622 | B2 | 3/2003 | Conrad |
| 6,543,491 | B1 | 4/2003 | Chung |
| 6,626,092 | B2 | 9/2003 | Tarlow |
| 2003/0140603 | A1 | 7/2003 | Krasenics, Jr. et al. |
| 2004/0177595 | A1 | 9/2004 | Kozak |
| 2005/0023179 | A1 | 2/2005 | Albritton |
| 2005/0028494 | A1 | 2/2005 | Higer et al. |
| 2005/0072125 | A1 | 4/2005 | Salvaro |
| 2005/0076616 | A1 | 4/2005 | Bassett et al. |
| 2005/0178089 | A1 | 8/2005 | Small et al. |

FOREIGN PATENT DOCUMENTS

| | | |
|---|---|---|
| DE | 28 28 770 A1 | 1/1980 |
| DE | 33 35 151 | 4/1985 |
| DE | 33 40 340 | 5/1985 |
| DE | 35 00 803 | 7/1986 |
| EP | 0 811 556 A1 | 12/1997 |
| GB | 743261 | 1/1956 |

* cited by examiner

METHOD AND APPARATUS FOR VACUUM SEALING

RELATED APPLICATIONS

This application hereby claims the priority benefit under 35 U.S.C. § 119(e) of U.S. Provisional Application No. 60/520,351, filed on Nov. 17, 2003, and entitled "RECLOSABLE BAG VACUUM SYSTEM," and U.S. Provisional Application No. 60/576,980, filed on Jun. 4, 2004, and entitled "VACUUM APPARATUS FOR BUILT IN VACUUM SUCTION SYSTEMS TO EVACUATE AIR FROM RECLOSABLE FOOD STORAGE SYSTEM," each of which is hereby incorporated by reference in its entirety.

BACKGROUND OF THE INVENTION

1. Field of the Invention

The present invention generally relates to vacuum sealing. More particularly, the present invention relates to using a vacuum source for removing air from a container.

2. Description of the Related Art

Vacuum sealing of containers is a widely used technique for food preservation and storage. In general, food or other articles are placed within a specialized container from which air is evacuated through a vacuum sealing system. Conventional vacuum sealing systems generally include a vacuum source and a container sealing device, such as a bag welder. These systems also generally include a one-way valve usable with the container such that air may be removed from the container without the air flowing back in.

Many conventional vacuum sealing systems are bulky and complex and require the purchase of specialized equipment and/or proprietary containers. For example, many vacuum sealing systems function only with specialized containers, such as customized jars or single-use plastic bags. When using the single-use bags, the vacuum sealing system often uses a heating portion to weld the bag opening shut. After the bags are opened, they can no longer be reused for vacuum sealing and are usually discarded. The repeated purchase of these customized containers can be expensive and burdensome for the user. Thus, there is room for improvement in vacuum sealing technology useful for those who desire an apparatus that has a more straightforward manner of use and that does not require the use of customized containers.

SUMMARY OF THE INVENTION

Accordingly, one aspect of the present invention involves a device for facilitating vacuum sealing using a central in-house vacuum system. The device comprises an elongated air inlet nozzle having a tubular end configured to be inserted into a resealable container. The device further comprises a hollow intermediate section having a first port for communicating with a central in-house vacuum system and a second port for communicating with the nozzle. The device also includes an inline contamination filter located between the nozzle end and the first port of the intermediate section. The contamination filter generally permits air flow through the nozzle and the intermediate section but greatly reduces the likelihood of contaminants from entering the central in-house vacuum system through the nozzle end.

Another aspect of the present invention involves a device for use in vacuum sealing a resealable container. The device comprises a cover plate generally adapted to attach to a wall port of a central vacuum system. The device further comprises an intermediate portion having an inlet port and an outlet port that communicates with the cover plate. The device also comprises an elongated air inlet portion having a tubular end, a connector end and a lumen. The connector end is moveably attached to the intermediate portion, and the lumen communicates with the inlet port. A contamination filter is located in at least one of the cover plate, the intermediate portion and the air inlet portion. The device also comprises an actuator generally configured to activate the central vacuum system such that air is drawn in through the air inlet portion when the tapered end of the inlet portion is moved in a substantially downward direction.

Another aspect of the present invention involves an apparatus for use in vacuum sealing a resealable container. The apparatus comprises a vacuum source and an intermediate portion having a first port in communication with the vacuum source. The intermediate portion further comprises a second port. The apparatus also comprises an elongated air inlet portion having a tapered end, a connector end and a lumen extending between the tapered end and the connector end. The connector end couples to the intermediate portion such that the lumen communicates with the second port. The tapered end of the inlet portion is oriented in a downward direction such that the tapered end is vertically lower than the connector end when the apparatus is in use. A contamination filter is disposed in at least one of the intermediate portion and the air inlet portion.

Another aspect of the present invention involves a device for facilitating vacuum sealing using a central in-house vacuum system. The device comprises an elongated air inlet portion having a tubular end configured to be inserted into a resealable container. The device also includes an intermediate section having a first port adapted to communicate with the central in-house vacuum system and a second port in communication with the inlet portion. A collection chamber is generally disposed between the first port and the second port. The intermediate portion further comprises a mounting plate configured to attach to a substantially planar surface.

Another aspect of the present invention involves a method for vacuum sealing an article in a flexible, resealable container. The method includes placing an article within a flexible, resealable container having an opening. An elongated air inlet portion, which communicates with a central in-house vacuum, is inserted into the opening. The opening is then substantially sealed around the inlet portion. The method further includes triggering the central in-house vacuum system to withdraw air from the flexible, resealable container through the inlet portion. The inlet portion is then removed from the flexible, resealable container. The flexible, resealable container is then substantially sealed with the article contained therein.

Another aspect of the present invention involves an apparatus for use in vacuum sealing a resealable container. The apparatus comprises means for accessing the interior of a flexible, resealable container. The apparatus further includes means for communicating with a wall port of a central vacuum system and means for coupling the accessing means to the communicating means such that air is drawn through the accessing means when the central vacuum system is active. The apparatus also includes means for substantially impeding contaminants from entering the central vacuum system through the accessing means and the communicating means. The substantially impeding means is disposed in at least one of the accessing means, the communicating means and the coupling means. The apparatus also comprises means for activating the central vacuum system in response to a particular movement of the accessing means.

BRIEF DESCRIPTION OF THE DRAWINGS

These and other features, aspects and advantages of the present invention will now be described with reference to the drawings of several preferred embodiments, which embodiments are intended to illustrate and not to limit the invention. The drawings comprise 14 figures.

DETAILED DESCRIPTION OF THE PREFERRED EMBODIMENTS

With reference now to FIGS. 1–10, a vacuum sealing apparatus 30 is shown. The illustrated vacuum sealing apparatus 30 is specifically adapted for use in removing air from containers. In a preferred embodiment, the vacuum sealing apparatus 30 is configured to remove air from resealable containers. In a more preferred embodiment, the vacuum sealing apparatus 30 is configured to remove air from flexible, resealable containers, such as for example, but without limitation, ZIPLOC® or GLAD® zipper-sealed bags. In other arrangements, the vacuum sealing apparatus 30 is configurable to remove air from a wide variety of containers, such as bags, jars, canisters and the like.

The vacuum sealing apparatus 30 is advantageously adapted to communicate with a vacuum source. The vacuum source provides enough suction to draw air from a container and through at least a portion of the vacuum sealing apparatus 30. Preferably, the vacuum source is independent of, or external to, the vacuum sealing apparatus 30. For example, the vacuum source may comprise a central in-house vacuum system, a vacuum pump, a fan, or the like. For exemplary purposes, the vacuum sealing apparatus 30 will be described first with reference to use with a central in-house vacuum system. In some arrangements, a dedicated vacuum source can be connected to the vacuum sealing apparatus 30.

Figure 1:
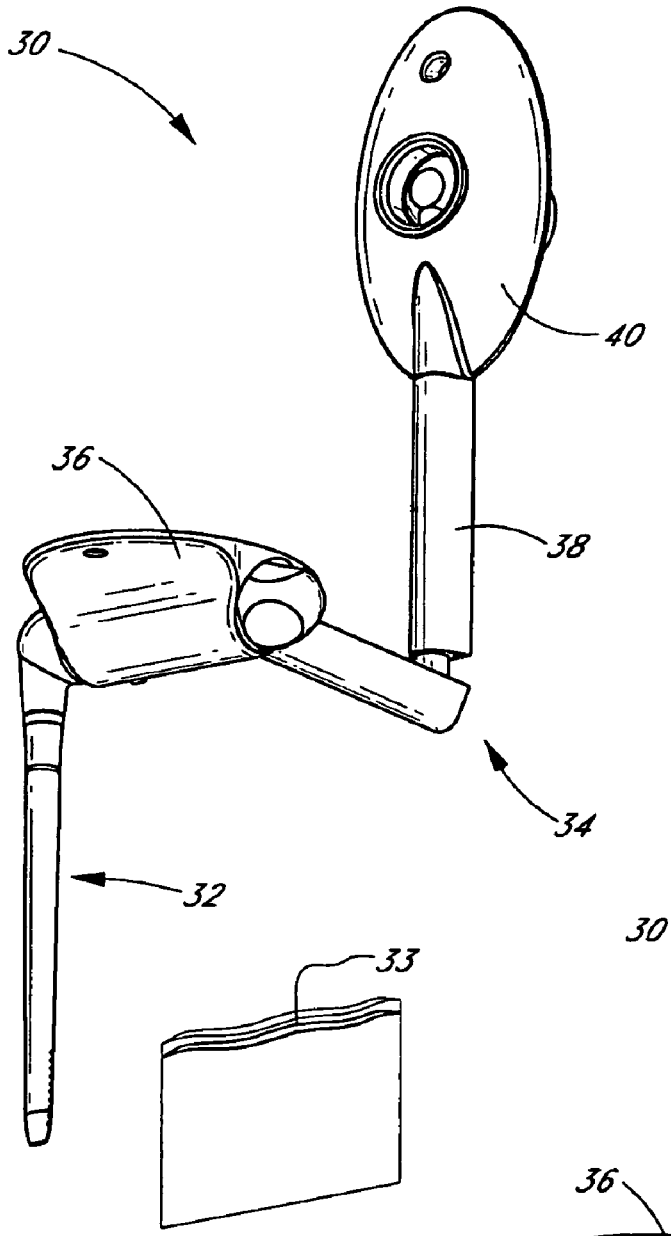
FIG. 1 is a perspective view of a vacuum sealing apparatus arranged and configured in accordance with certain features, aspects and advantages of the present invention. The vacuum sealing apparatus is shown with an inlet portion in a generally vertical position.

With reference to FIG. 1, the illustrated vacuum sealing apparatus 30 generally comprises an inlet portion 32 and an intermediate portion 34. The inlet portion 32 is advantageously adapted to be inserted into a resealable container 33. As illustrated, the inlet portion 32 is generally of a tubular structure having a lumen that extends through the inlet portion 32. The inlet portion 32 couples to the intermediate portion 34 such that the lumen of the inlet portion 32 communicates with a port of the intermediate portion 34.

As used herein, the term "tubular" includes its ordinary broad meaning, which includes a hollow structure, of any shape or cross-section, having at least two openings that allow for the passage of a liquid, solid and/or gas. For example, FIG. 1 depicts the tubular inlet portion 32 as having an elongated, substantially cylindrical structure. In other arrangements, the tubular inlet portion 32 can take the form of a duct and/or can include a polygonal cross-section, an elliptical cross-section, combinations of the same or the like.

The illustrated intermediate portion 34 further comprises a chamber body 36, an elongated connector 38 and a cover plate 40. The intermediate portion 34 advantageously comprises at least one common passageway that extends through each of the chamber body 36, the elongated connector 38 and the cover plate 40, such that air may flow therethrough. In a preferred configuration, the chamber body 36 comprises an inlet port that communicates with the lumen of the inlet portion 32.

Furthermore, the cover plate 40 preferably comprises an outlet port and couples to a wall port of an in-house vacuum system. In such a configuration, the in-house vacuum system can be used to draw air in through the inlet portion 32 and the intermediate portion 34 in order to vacuum seal a container.

The intermediate portion 34 of the illustrated vacuum sealing apparatus 30 is configured to mount to a substantially planar surface. For example, the intermediate portion 34 is mountable on a substantially horizontal surface, such as underneath a cabinet, a counter, cupboard, or other like surface. In other arrangements, the intermediate portion 34 can be mounted to a substantially vertical surface, such as a backsplash or a wall. Furthermore, the wall plate 40 is configured to mount to a wall surface having a wall port of an in-house vacuum system. In other configurations, the vacuum sealing apparatus 30 is portable or can stand in an upright position.

In one arrangement, the vacuum sealing apparatus 30 further comprises a filter that substantially reduces or eliminates contaminants, such as dust and debris, from the in-house vacuum system from traveling though the vacuum sealing apparatus 30 and out the inlet portion 32 (e.g., into the container being vacuum sealed). Furthermore, the filter generally impedes food, liquid, or other materials, which are stored in a container to be vacuum sealed, from entering the in-house vacuum system through the vacuum sealing apparatus 30. Preferably, the filter comprises an inline contamination filter that allows for the flow of air through the vacuum sealing apparatus 30 and that substantially reduces the flow of liquid and/or other particles out of the vacuum sealing apparatus 30. As will be appreciated, one or more filters can be disposed in one more locations within the inlet portion 32 and/or the intermediate portion 34.

FIG. 1 further depicts the vacuum sealing apparatus 30 having the inlet portion 32 in a substantially vertical, or a deployed, position. In particular, the lumen of the inlet portion 32 is directed in a substantially downward direction. Such an orientation of the inlet portion 32 allows a user to keep the opening of the container to be vacuum sealed in a substantially upward orientation, which reduces the likelihood of materials inside the container falling out during the vacuum sealing process.

Figure 2:
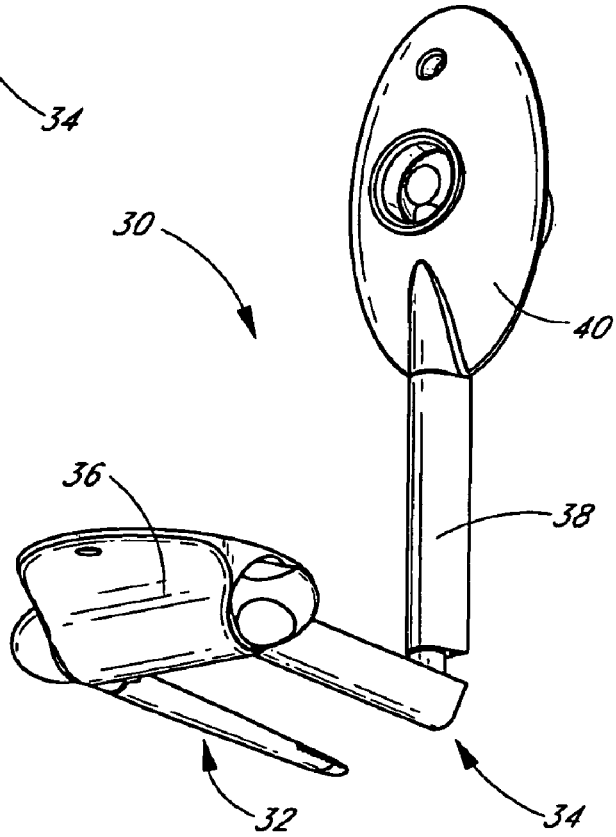
FIG. 2 is a perspective view of the vacuum sealing apparatus of FIG. 1 with the inlet portion in a generally horizontal position.

FIG. 2 illustrates the inlet portion 32 in an elevated or substantially horizontal position. In one arrangement, the inlet portion 32 is oriented in such a position when the in-house vacuum system is in an off or non-operating state such that air is not drawn in through the vacuum sealing apparatus 30. Such a position also advantageously decreases the amount of space occupied by the vacuum sealing apparatus 30 when it is not in use.

In one configuration, movement of the inlet portion 32 from the substantially horizontal position (as shown in FIG. 2) to the substantially vertical position (as shown in FIG. 1) activates the in-house vacuum system. As a result, air is drawn in through the inlet portion 32 so as to permit vacuum sealing. Likewise, movement of the inlet portion 32 back to the horizontal position deactivates the in-house vacuum system. In another configuration, to activate the in-house vacuum system, the user pulls the inlet portion 32 a certain amount while the inlet portion 32 is in the substantially vertical position.

Figure 3:
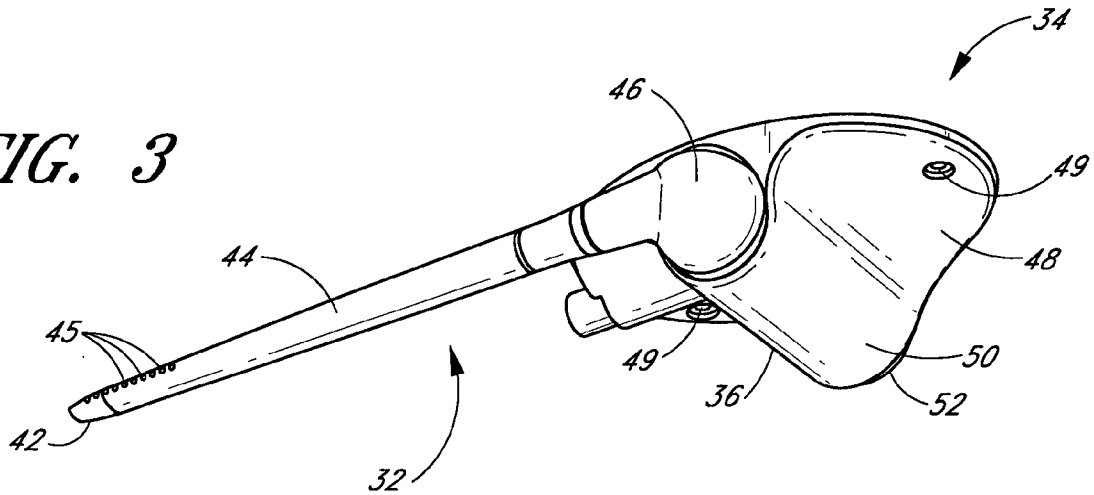
FIG. 3 is a perspective view of the inlet portion and a chamber body of the intermediate portion of the vacuum sealing apparatus of FIG. 1.

With reference to FIG. 3, the illustrated inlet portion 32 further comprises a nozzle having a tapered end 42, an elongated body 44 and a connector 46. The tapered end 42 facilitates the insertion of the inlet portion 32 in container openings. In addition, the tapered end 42 allows for the user to gradually remove the inlet portion 32 from the container while preventing a substantial amount of air from flowing into the container.

The illustrated elongated body 44 preferably comprises a tubular structure. In one configuration, the elongated body 44 comprises a rigid material, such as, for example, a plastic or a light-weight metal. In other configurations, the elongated body 24 comprises a flexible material, such as a rubber or the like. Such flexibility allows a user more freedom in orienting the container to be vacuum sealed. The elongated body 44 also provides for varying depths of insertion of the inlet portion 32 into containers of various sizes and/or shapes.

Furthermore, the illustrated inlet portion 32 comprises a plurality of inlet holes 45 extending through the elongated body 44 from an outside surface of the body 44 to a lumen extending through the body 44. These inlet holes 45 provide for multiple locations in which air can be drawn in through the inlet portion 32. In other configurations, the inlet portion 32 may not include the inlet holes 45, or the inlet holes 45 may be selectively closeable by the user.

The connector 46 couples the inlet portion 32 to the intermediate portion 34. In one configuration, the connector 46 allows for movement of the inlet portion 32 with respect to the intermediate portion 34. Preferably, the connector 46 is rotatable so as to allow the inlet portion 32 to move with at least one degree of freedom, such as between a substantially vertical position and a substantially horizontal position, as described above. For example, the connector 46 may comprise a hinge or other pivoting mechanism. In other arrangements, the connector 46 comprises a multi-axial configuration or a polycentric configuration allowing for multiple degrees of movement of the inlet portion 32.

In yet other arrangements, the inlet portion 32 is in a fixed position with respect to the intermediate portion 34. In such an arrangement, the tapered end 42 of the inlet portion 32 preferably points in a substantially downward direction. As described above, this downward orientation helps reduce the likelihood of materials from falling out of the containers to be vacuum sealed and/or reduce the flow of contaminants into the inlet portion 32.

Although the inlet portion 32 is described above with respect to particular arrangements, a wide variety of other configurations can be used. For example, the intermediate portion 34 may further comprise a spring or other similar retraction device that causes the inlet portion 32 to automatically retract from a substantially vertical position to a substantially horizontal position when the inlet portion 32 is not in use. In other arrangements, the inlet portion 32 may comprise a telescoping nozzle that allows for extension and retraction of the inlet portion 32, or the inlet portion 32 can be removably coupled to the intermediate portion 34, such as by a snap-on feature, for example. This removability facilitates cleaning and/or replacement of the inlet portion 32. For example, the vacuum sealing apparatus 30 may comprise multiple interchangeable inlet portions 32 that are adapted to be used in different vacuum sealing environments, such as with different containers.

With continued reference to FIG. 3, the illustrated chamber body 36 of the intermediate portion 34 further comprises a mounting plate 48 usable to secure the vacuum sealing apparatus 30 to a substantially planar surface, as described previously. For example, the mounting plate 48 may use adhesives, screws, bolts, hooks, or other like securing devices and/or materials for attaching the mounting plate 48 to a surface. The illustrated mounting plate comprises holes 49 for this purpose.

Figure 4:
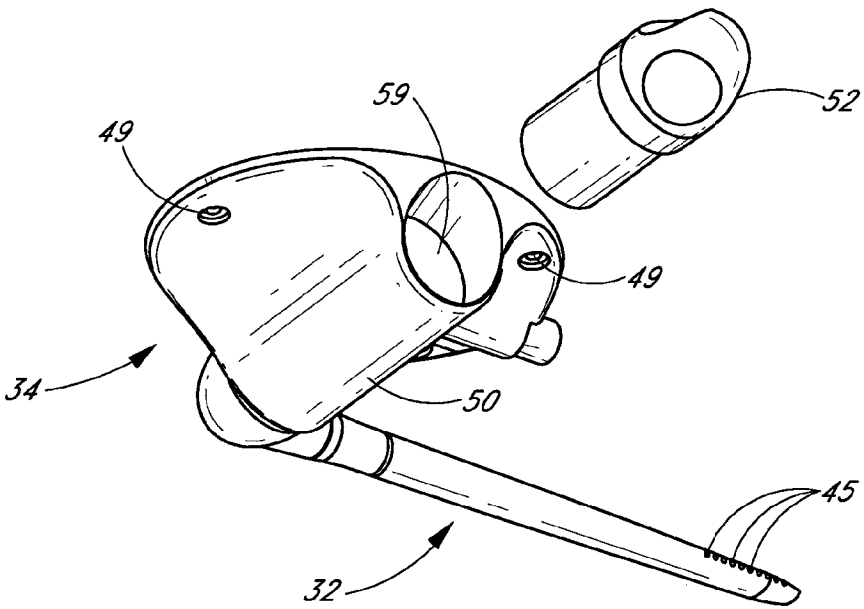
FIG. 4 is a perspective view of the vacuum sealing apparatus of FIG. 1 having an access cap removed from the chamber body.

The chamber body 36 further comprises a main housing 50 and an access cap 52. In one configuration, the main housing 50 forms or encompasses a collection chamber, such as a catch basin or a spillage chamber, usable to collect excess materials that are drawn in through the inlet portion 32. Removal of the access cap 52 facilitates user access to the collection chamber for cleaning and other maintenance. FIG. 4 further illustrates the chamber body 36 with the access cap 52 removed from an opening 59.

Figure 5:
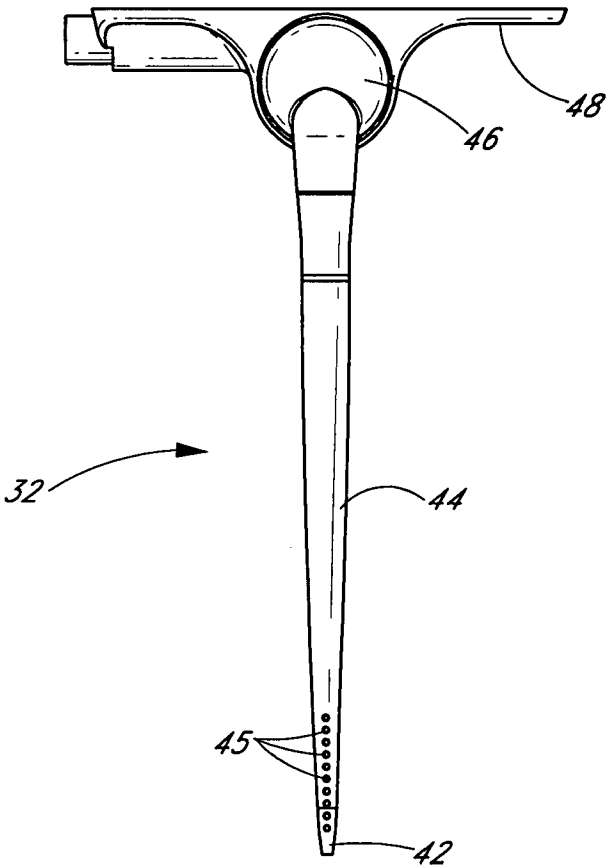
FIG. 5 is a side view of the inlet portion and the chamber body of the vacuum sealing apparatus of FIG. 1.

With reference to FIG. 5, the inlet portion 32 is again depicted in a substantially vertical, or deployed, orientation. In particular, the tapered end 42 of the inlet portion 32 is positioned vertically lower than the connector 46, and the elongated body 44 is in a substantially vertical orientation. FIG. 5 further illustrates the inlet portion 32 coupled to the intermediate portion 34 through the rotatable connector 46. In addition, FIG. 5 depicts the plurality of inlet holes 45 extending through the elongated body 44 of the air inlet portion 32.

Figure 6:
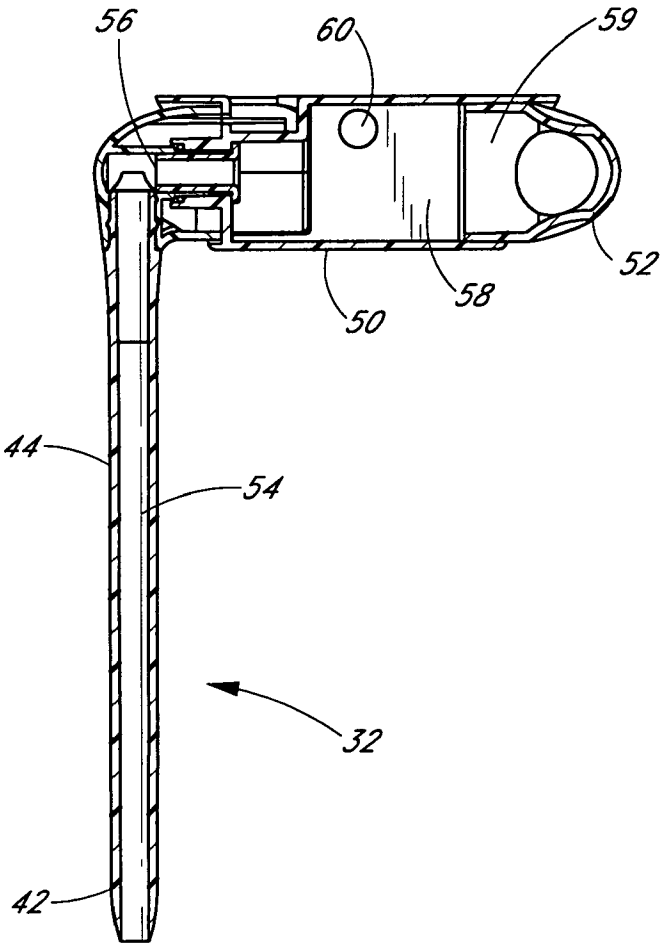
FIG. 6 is a side cross-sectional view of the inlet portion and the chamber body of the vacuum sealing apparatus of FIG. 1.

FIG. 6 illustrates a side cross-sectional view of the inlet portion 32 and the chamber body 36 of the intermediate portion 34. The illustrated inlet portion 32 further comprises a lumen 54 that extends the length of the elongated body 44.

The illustrated inlet portion 32 couples to the chamber body 36 such that the lumen 54 communicates with an inlet port 56 of the chamber body 36.

As described above, the chamber body 36 further comprises a collection chamber 58 that provides a location in which contaminants, such as liquids or particles, may accumulate when passing into the chamber body 36. As illustrated, the inlet port 56 is advantageously located at an elevated position with respect to a bottom portion of the collection chamber 58. Such a location helps prevent or impede food or liquid that is inadvertently drawn in through the inlet portion 32 and the inlet port 56, and that may accumulate in the collection chamber 58, from returning into the inlet port 56 or substantially blocking the port 56.

As illustrated, the chamber body 36 also comprises an exhaust port 60 that allows for air drawn in through the inlet port 56 to exit the chamber body 36. The exhaust port 60 preferably communicates with the elongated connector 38. Furthermore, the exhaust port 60 is advantageously located at an elevated position with respect to a bottom portion of the collection chamber 58. For example, the illustrated exhaust port 60 is located on the side of the collection chamber 58. Such positioning helps prevent or impede contaminants that may accumulate in the collection chamber 58 from being drawn into the elongated connector 38 and, in turn, into the vacuum source. This also helps remove larger particles and/or drops of liquid from air flowing through the collection chamber 58.

In another arrangement, the inlet port 56 and/or the exhaust port 60 can be located at the top of the collection chamber such that the opening of the port is oriented in a generally downward direction. In yet another arrangement, the exhaust port 60 can include baffles, screens, or the like usable to substantially impede particles and/or liquid from entering the exhaust port 60.

With continued reference to FIG. 6, the chamber body 36 further comprises the opening 59 that is closed by the access cap 52. As discussed previously, the access cap 52 is preferably at least partially removable to facilitate user access to the chamber body 36. In particular, removing the access cap 52 allows the user to remove accumulated contaminants from the collection chamber 58. The access cap can be connected to the chamber body through a threaded or friction coupling, a snap fit, or the like. In another configuration, the access cap 52 is located on other portions of the chamber body 36. For example, the access cap 52 can be located at the bottom of the collection chamber 58. In yet other configurations, the chamber body 36 comprises another apparatus or device, such as a slideable window, that facilitates cleaning of the chamber body 36.

Although described with reference to particular arrangements, a wide variety of alternative configurations are useable with the vacuum sealing apparatus 30. For example, the chamber body 36 may further comprise a filter, as described above, located downstream from the collection chamber 58. For example, the filter can be disposed within the exhaust port 60 or the connector 38. In yet other configurations, the chamber body 36 may comprise a one-way stopper configured to substantially impede the movement of materials between the inlet portion 32 and the chamber body 36. For example, the one-way stopper can be located within or near the inlet port 56 and may be used in combination with the above-described filter.

Figure 8:
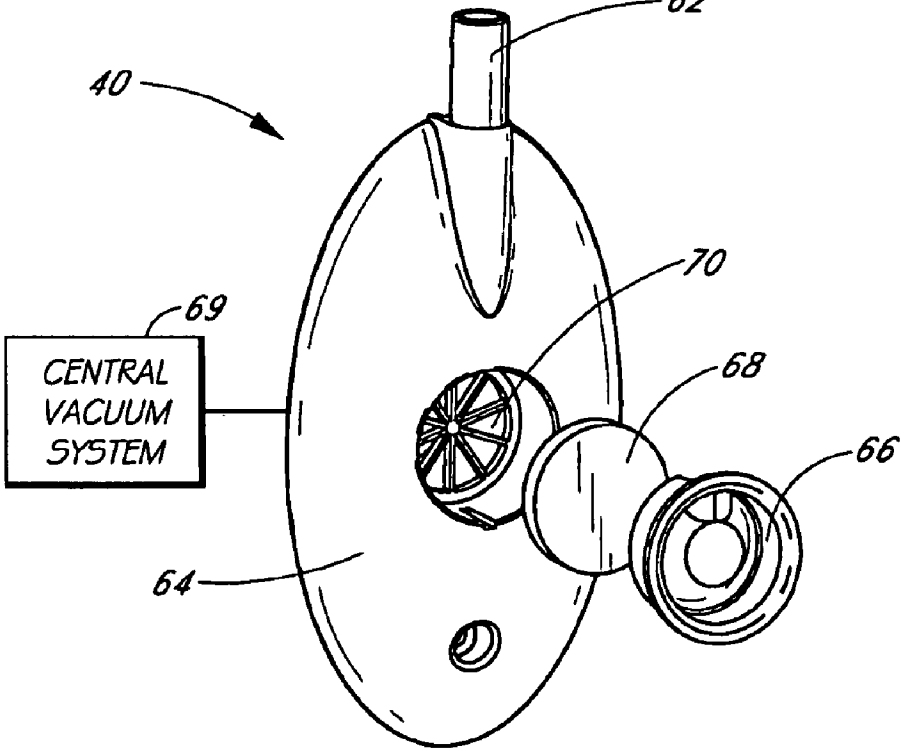
FIGS. 7 and 8 are perspective and exploded views respectively of a cover plate of the vacuum sealing apparatus of FIG. 1.
Figure 7:
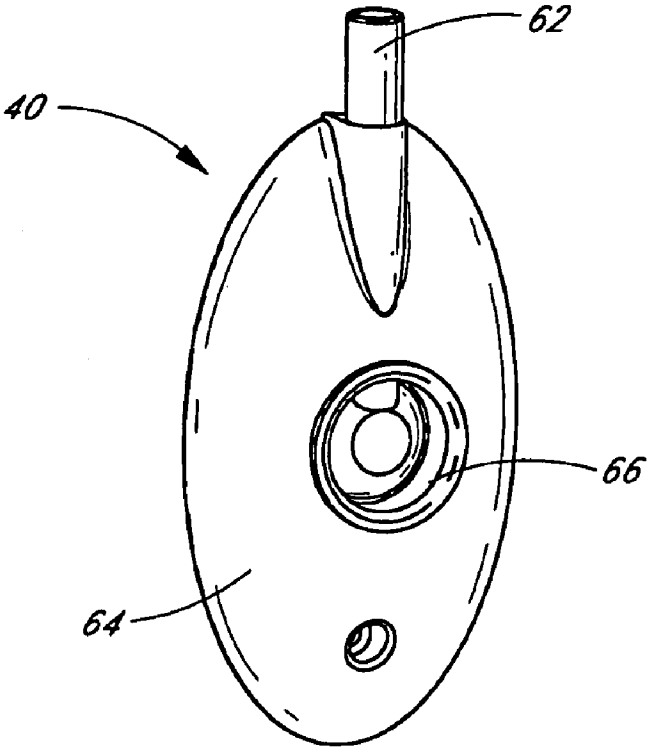

With reference now to FIGS. 7 and 8, the illustrated cover plate 40 is in communication with a central vacuum system 69 and comprises an adapter 62 for coupling the elongated connector 38 to a mounting portion 64. The illustrated mounting portion 64 comprises a disk-shaped surface having a flat side and an opposing, substantially convex side. The flat side of the mounting portion 64 facilitates attachment of the mounting portion 64 to a variety of planar surfaces, such as a wall. In particular, the mounting portion 64 is preferably configured to attach to a portion of a wall having an in-house vacuum system port. In one arrangement, the cover plate 40 can be substituted for a conventional in-house vacuum system cover plate or outlet cover. In such an arrangement, the cover plate 40 advantageously couples to existing wall port contacts or switches that control the operation of the in-house vacuum system. As a result, the operation of the vacuum sealing apparatus 30 is used to activate the in-house vacuum system during the vacuum sealing process.

The illustrated cover plate 40 further comprises a removable access cap 66. With reference to FIG. 8, removal of the access cap 66 facilitates access to a filter 68 and to an outlet port 70. In one embodiment, the filter 68 comprises an inline contamination filter that prevents or impedes contaminants, such as dust or debris, from entering the vacuum sealing apparatus 30 through the outlet port 70, which communicates with the in-house vacuum system. The filter 68 preferably allows for the flow of air but prevents or impedes the flow of liquids or particles through the outlet port 70. The filter 68 is also preferably removable such that a user can periodically examine, clean and/or replace the filter 68 to enable better performance of the vacuum sealing apparatus 30.

Although the filter 68 is disclosed with reference to a particular configuration, a wide variety of alternative filters may be used with the vacuum sealing apparatus 30. For example, the filter 68 may comprise a hydrophilic material that substantially impedes or prevents the passage of water. In another configuration, the filter 68 may comprise plurality of narrow passageways arranged in a labyrinth-type configuration. These passageways may allow for the passage of air but may impede particles or liquids from passing therethrough. In yet other configurations, a similar filter can be disposed within the inlet portion 32, the chamber body 36 or the elongated connector 38 instead of, or in combination with, the filter 68 in the cover plate 40.

Figure 9B:
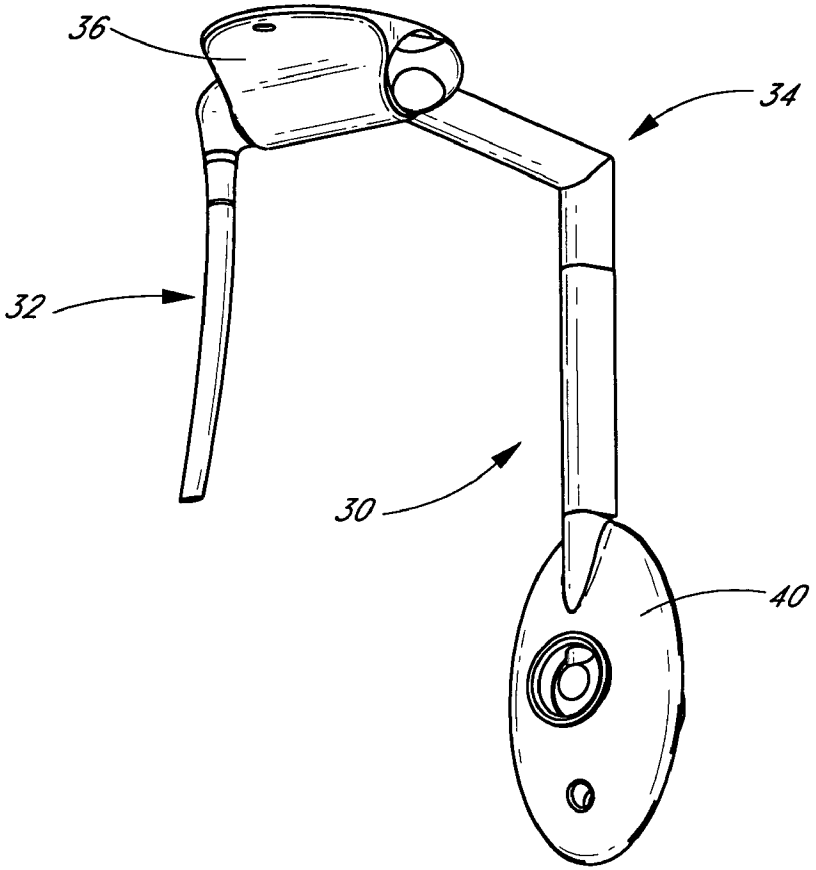
FIGS. 9A and 9B are perspective views of the vacuum sealing apparatus of FIG. 1 having the cover plate in a location below the intermediate portion.
Figure 9A:
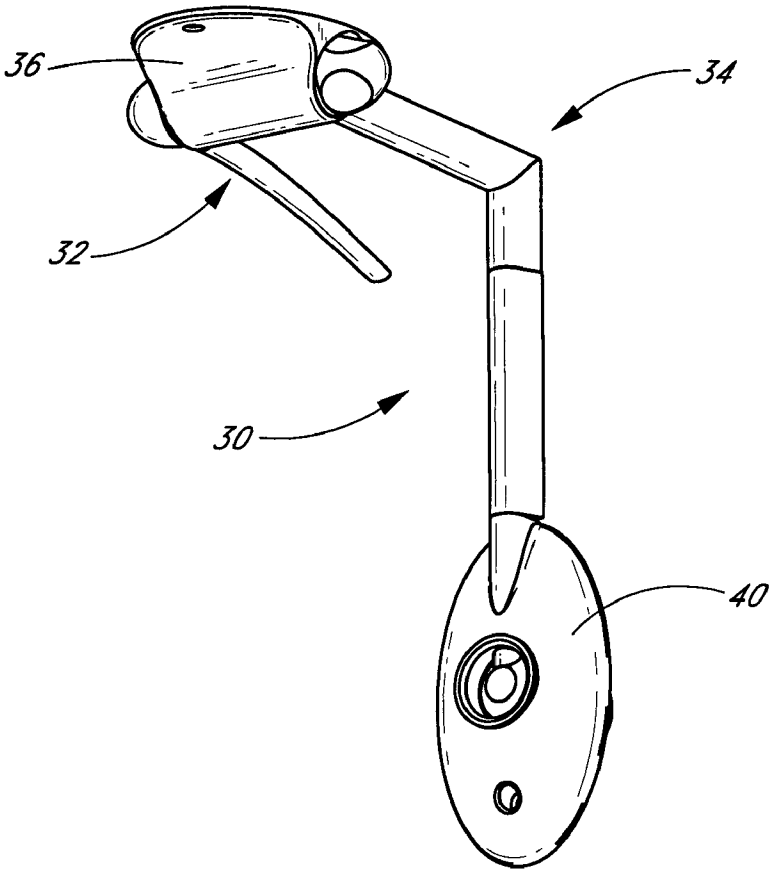

With reference to FIGS. 9A and 9B, the vacuum apparatus 30 is shown having the cover plate 40 located in a position below the chamber body 36. FIG. 9A depicts the inlet portion 32 in a retracted position, and FIG. 9B depicts the inlet portion 32 in a deployed position. Thus, differing positions between the cover plate 40 and the chamber body 36 can be used.

Figure 10:
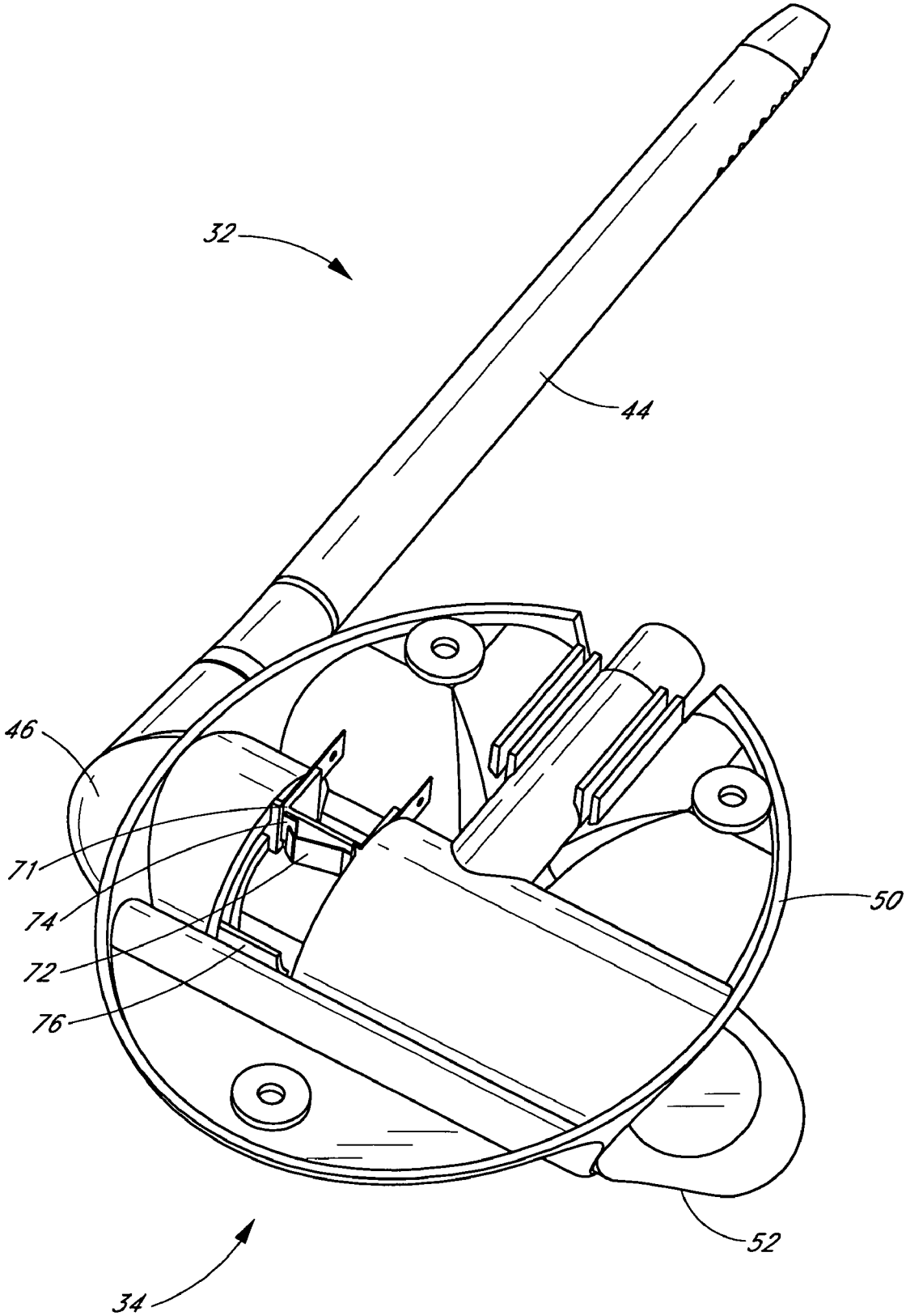
FIG. 10 is a bottom perspective view of the inlet portion and the chamber body of the vacuum sealing apparatus of FIG. 1, wherein a bottom portion of the chamber body is removed to show an actuator.

FIG. 10 illustrates a bottom view of the vacuum apparatus 30 with a bottom portion of the chamber body 36 removed to show components within the chamber body 36. In particular, FIG. 10 depicts an actuator 71 usable to control the operation of the vacuum source, such as the in-house vacuum system. As shown, the actuator 71 is an electrical switch and further comprises a contact arm 72 and a contact pad 74. The actuator 71 is further coupled to the inlet portion 32 such that rotation of the elongated body 44 about the connector 46 causes a corresponding movement of the actuator 71. In particular, when the elongated body 44 of the inlet portion 32 is rotated to a substantially vertical position, a protrusion 76 comes in physical contact with the contact arm 72 and causes the contact arm 72 to touch the contact plate 74. This contact between the contact arm 72 and the contact plate 74 creates an electrical connection that causes the vacuum source, such as an in-house vacuum system, to turn on. Likewise, when the elongated body 44 is rotated back to a substantially horizontal position, as is shown in FIG. 10, the contact arm 72 separates from the contact plate 74 and breaks the electrical connection, which causes the vacuum source to cease operating.

In yet other configurations, the actuator 71 may comprise a manual switch, one or more sensors, or the like. The actuator 71 may also be configured to couple to existing contacts or switches of the in-house vacuum system, such as in a conventional wall port, or the actuator 71 may communicate through wireless channels, such as radio frequency (RF) communication, with the vacuum source.

Furthermore, the vacuum sealing apparatus 30 may comprise a variable control that allows the user to manage how much air is being drawn through the vacuum sealing apparatus 30. For example, the variable control may adjust the size of one of more passageways or ports of the vacuum sealing apparatus 30, which may include, for example, the lumen 54, the inlet port 56, the exhaust port 60 and/or the outlet port 70. In one embodiment, the level of vacuum varies with the position of the inlet portion 32 relative to the chamber body 36. The variability can be achieved mechanically (e.g., flow constriction) or electrically (e.g., regulating the power of the vacuum source).

For exemplary purposes, a preferred method of use of the vacuum sealing apparatus 30 with a resealable container will now be described. The user inserts the tapered end 42 of inlet portion 32 in a container to be vacuum sealed. For example, the inlet portion 32 can be inserted in the opening of a zipper-type, resealable bag that contains food items. The depth of insertion may depend on the size of the bag and the properties of its contents. Once the inlet portion 32 is inserted into the bag opening, the user forms a substantial seal around the inlet portion 32 by closing the bag opening around the inlet portion 32.

Once the bag is substantially sealed around the inlet portion 32, the user then pulls the inlet portion 32 forward or downward to activate the in-house vacuum system. In some configurations, the inlet portion 32 can be moved into a substantially downward direction before placing the tapered end 42 into the bag. As the in-house vacuum system evacuates air from the bag, the user slowly slides the bag down the inlet portion 32 while keeping enough downward pressure on the inlet portion 32 to keep the in-house vacuum system activated. The tapered shape of the inlet portion 32 allows the user to gradually seal the opening of the bag while moving the bag down the inlet portion 32.

Once the air is substantially removed from the bag, the user releases the downward pressure on the inlet portion 32, which deactivates the in-house vacuum system. The user preferably slides the bag completely off the inlet portion 32 and seals the remaining bag opening to prevent unwanted air from returning into the bag. Once the bag is removed from the inlet portion 32, the inlet portion is returned into the substantially horizontal position. In configurations wherein the inlet portion 32 comprises an automatic retraction device, such a spring, the inlet portion 32 automatically returns to the horizontal position when the user no longer exerts pressure on the inlet portion 32.

As can be seen, the above-described method advantageously provides for a substantial "hands free" vacuum sealing process. That is, the user may vacuum seal a container without substantial use of his or her hands to hold and/or manipulate the vacuum sealing apparatus 30. Instead, the user is able to hold and secure the container throughout the vacuum sealing process.

Furthermore, the vacuum sealing apparatus 30 does not require the use of specialized bags or containers and allows for repeated vacuum sealing of resealable containers, such as zipper-type bags. This is because the vacuum sealing apparatus 30 need not puncture or heat seal the bag during the vacuum sealing process.

Figure 11A:
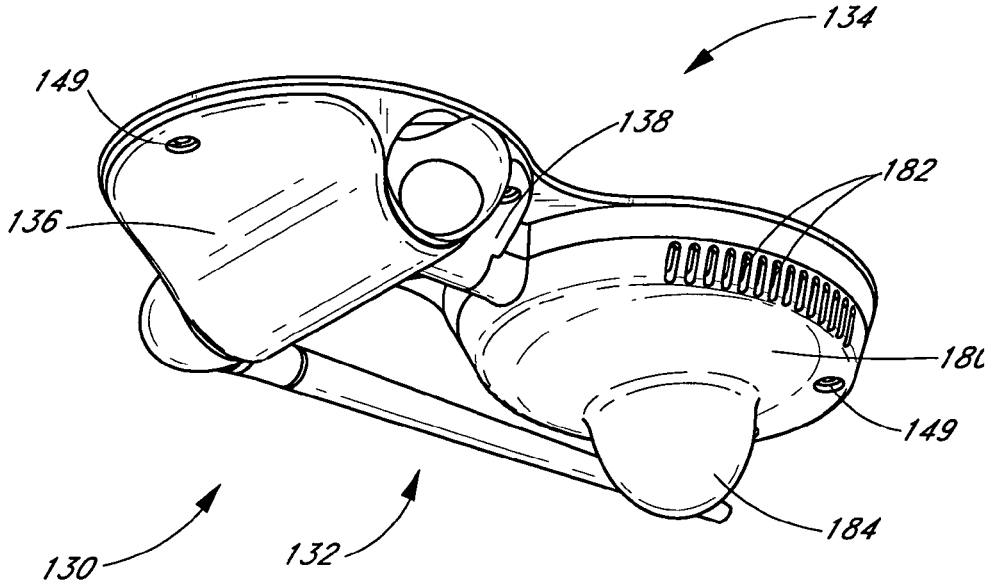
FIGS. 11A and 11B are perspective views of another vacuum sealing apparatus arranged and configured in accordance with certain features, aspects and advantages of the present invention.
Figure 11B:
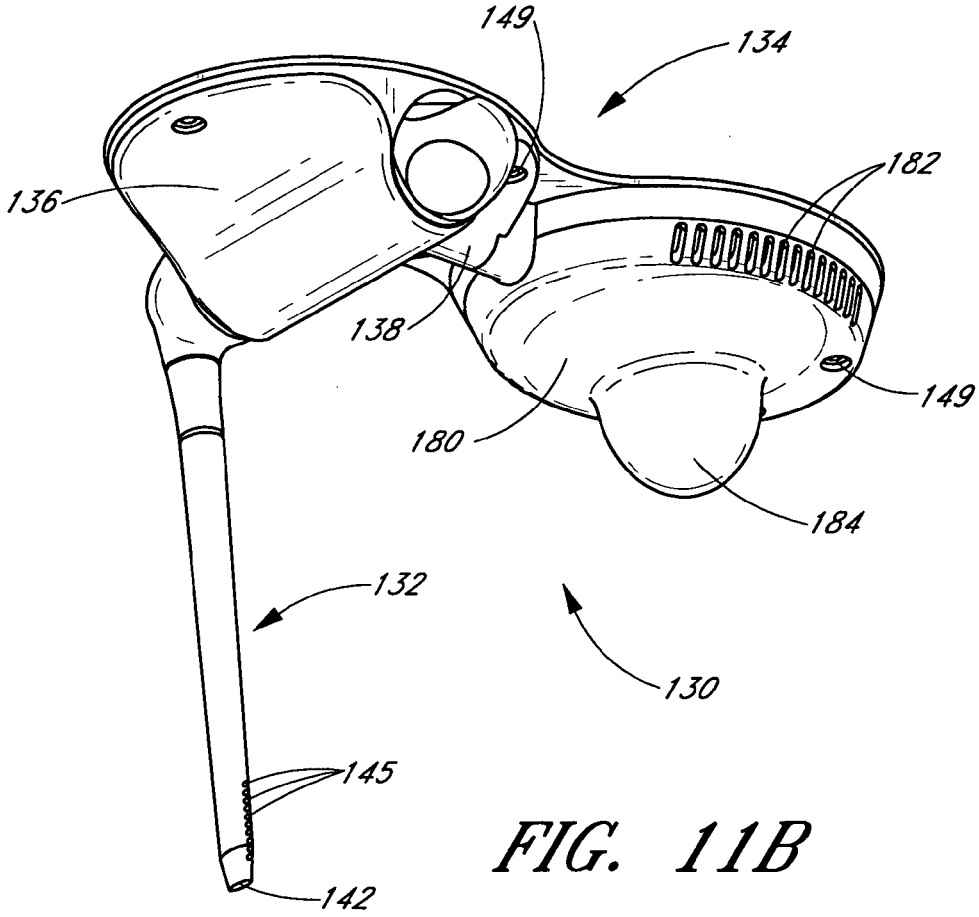

With reference now to FIGS. 11A and 11B, another vacuum sealing apparatus 130 is shown that is arranged and configured in accordance with certain features, aspects and advantages of the present invention. To simplify the description, components will not be redescribed in detail if they were described above. Rather, the components in the embodiment of FIGS. 11A and 11B will be given a reference numeral that retains the same last two digits as the reference numeral used in the embodiment of FIGS. 1–10, and the last two digits will be preceded with a numeral "1." Thus, the vacuum sealing apparatus 130 generally corresponds to the vacuum sealing apparatus 30 with certain differences that will be illuminated in the following discussion.

The vacuum sealing apparatus 130 advantageously is self-contained and does not require an external vacuum source, such as an in-house vacuum system. With particular reference to FIG. 11A, the vacuum sealing apparatus 130 comprises an inlet portion 132 and an intermediate portion 134, which further comprises a chamber body 136 and a connector 138. The chamber body 136 further includes holes 149 for securing the vacuum sealing apparatus to a surface such as, for example, a wall, a cabinet, a cupboard, a shelf or the like.

In contrast to the vacuum sealing apparatus 30 of FIGS. 1–10, the vacuum sealing apparatus 130 comprises a vacuum source 180. For example, the vacuum source may comprise a vacuum pump, a fan, or other apparatus or device usable to create air flow. The vacuum source 180 preferably draws air in through the inlet portion 132 and out exhaust vents 182. In one configuration, the vacuum source 180 is powered by an AC power source, such as through a conventional electrical outlet. In another configuration, the vacuum source 180 is powered through a DC power source, such as by one or more batteries.

The vacuum sealing apparatus 130 also preferably comprises at least one contamination filter (not shown) similar to the filter 68 described previously. The contamination filter can be located within the inlet portion 132, the chamber body 136, or the connector 138.

As described previously with respect to the vacuum sealing apparatus 30, the inlet portion 132 can also be configured to move between a substantially horizontal position (shown in FIG. 11A) and a substantially vertical position (shown in FIG. 11B).

Furthermore, movement of the inlet portion 132 may activate the vacuum source 180 such that air is drawn through the inlet portion 132. In one arrangement, slightly pulling the inlet portion 132 along the direction of the body of the inlet portion 132 activates the vacuum source 180. For example, pulling the inlet portion 132 can trigger an actuator, such as an electrical switch, within the vacuum source apparatus 130. Such an actuator can be advantageously located at a position proximate to the coupling of the inlet portion 132 to the intermediate portion 134. In yet other arrangements, movement of the inlet portion 132 from a substantially horizontal position to a substantially vertical position activates the vacuum source 180. Likewise, movement of the inlet portion 132 back to the horizontal position deactivates the vacuum source 180.

Although described with reference to particular arrangements, a wide variety of alternative devices or methods can be used to activate the vacuum source 180. For example, a sensor or a switch can be located near the end of the inlet portion 132. When a container is brought near to or in contact with the end of the inlet portion 132, the vacuum source 180 begins operating. Likewise, when the container is removed from the inlet portion 132, the vacuum source 180 ceases operation. In yet other arrangements, the vacuum sealing apparatus 130 comprises a manual switch that the user activates and deactivates to control the functioning of the vacuum source 180.

As shown in FIGS. 11A and 11B, the vacuum sealing apparatus 130 optionally comprises a light source 184 that provides illumination in the area used for vacuum sealing. The light source 184 is preferably configured such that contaminants, such as liquids, that accumulate in the chamber body 136 do not interfere with the function of the light source 184.

Although the vacuum sealing apparatus 130 is described above with respect to particular arrangements, a wide variety of alternative configurations are contemplated. For example, the vacuum sealing apparatus 130 can be configured to stand alone in an upright position, such as on the top of a counter, instead of mounting underneath a surface. In yet other configurations, the vacuum sealing apparatus 130 is portable.

In one arrangement, the method of using the vacuum sealing apparatus 130 is similar to the above-disclosed methods of using the vacuum sealing apparatus 30.

Figure 12:
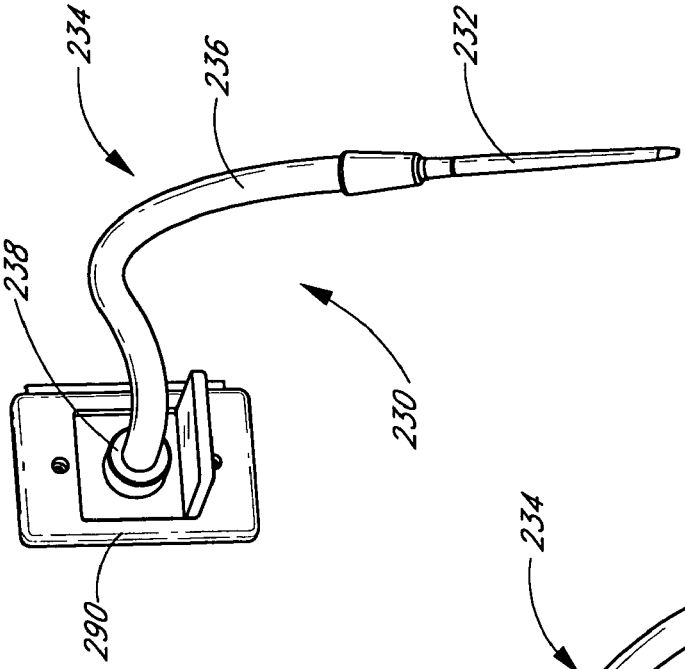
FIG. 12 is a perspective view of yet another vacuum sealing apparatus arranged and configured in accordance with certain features, aspects and advantages of the present invention.
Figure 13:
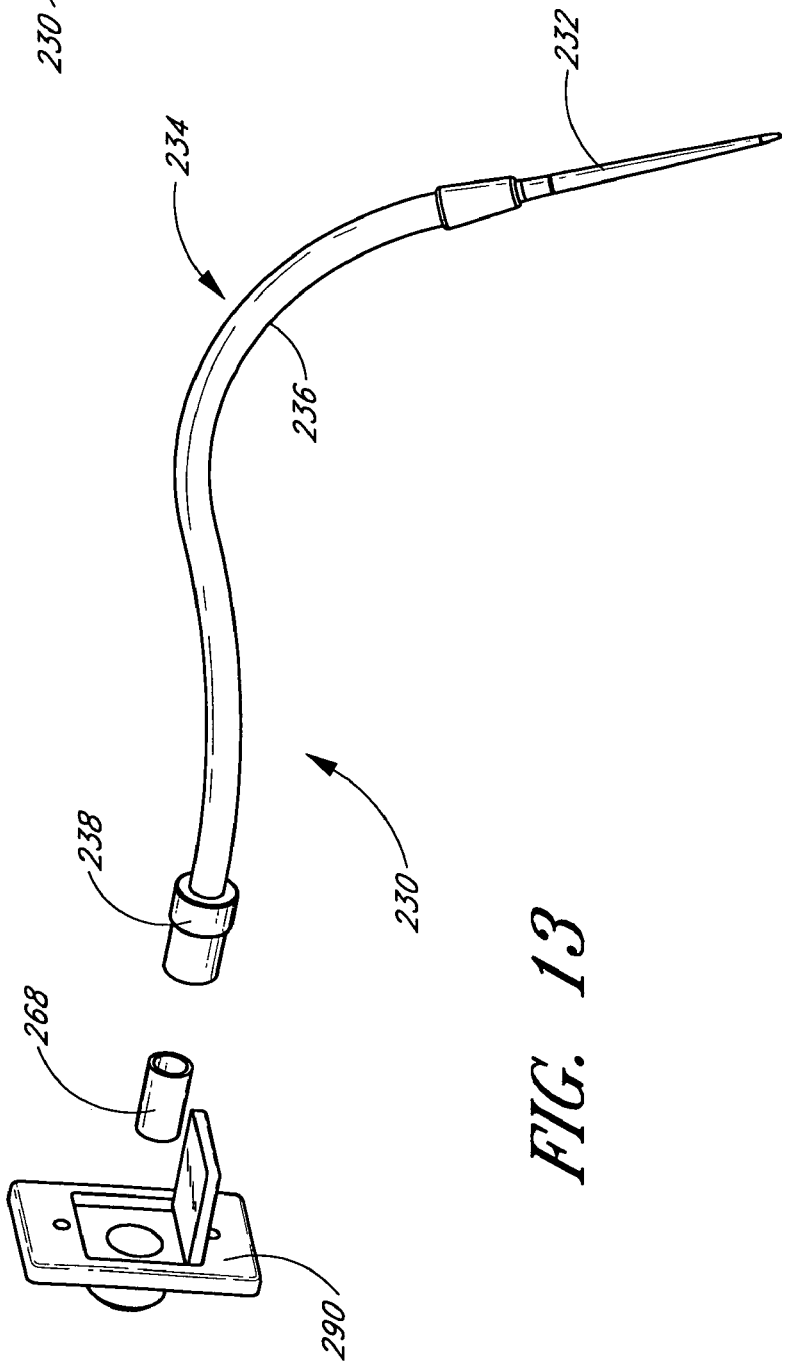
FIG. 13 is a perspective view of the vacuum sealing apparatus of FIG. 12 wherein a connector portion is dissembled to further illustrate a filter.

With reference now to FIGS. 12 and 13, an embodiment of a vacuum sealing apparatus 230 is illustrated that is arranged and configured in accordance with certain features, aspects and advantages of the present invention. Once again, to simplify the description, components will not be redescribed in detail if they were described above. Rather, the components in the embodiment of FIGS. 12 and 13 will be given a reference numeral that retains the same last two digits as the reference numeral used in the embodiments of FIGS. 1–11B, and the last two digits will be preceded with a numeral "2." Thus, the vacuum sealing apparatus 230 generally corresponds to the vacuum sealing apparatus 30 and the vacuum sealing apparatus 130 with certain differences that will be illuminated in the following discussion.

As shown, the vacuum sealing apparatus 230 comprises an inlet portion 232 and an intermediate portion 234. The illustrated intermediate portion 234 further comprises chamber body 236 and a connector 238. The chamber body 236 preferably comprises a tubular body made of a semi-flexible material, such as a plastic or rubber.

The connector 238 is preferably adapted to couple to a vacuum source port 290. In particular, the illustrated vacuum source port 290 comprises a wall port for an in-house vacuum system. Furthermore, coupling the connector 238 to the vacuum source port 290 advantageously triggers the operation of the in-house vacuum system by activating at least one contact, such as an electrical switch, generally used in conventional in-house vacuum system wall ports.

Although described with reference to one arrangement, the vacuum sealing apparatus 230 can be used with a wide variety of vacuum sources, such as, for example, household vacuum cleaners, portable vacuum systems, vacuum pumps, fans and the like. In yet other configurations, the connector 238 can be customized to couple to various vacuum sources, or multiple connectors or adapters can be used in place of, or in combination with, the illustrated connector 238.

With reference to FIG. 13, the illustrated vacuum sealing apparatus 230 further comprises a filter 268. Similar to the filter 68 of the vacuum sealing apparatus 30, the filter 268 is preferably an inline contamination filter that substantially reduces or eliminates the flow of particles and/or liquid between the vacuum source and the vacuum sealing apparatus 230. Preferably, the filter 268 is removable so as to permit cleaning and/or replacement. Although the illustrated filter 268 is disposed within the connector 238, it is to be understood that the filter 268 can be disposed in any location within the vacuum sealing apparatus 230 that allows for the blocking of particles or liquids. In yet other arrangements, the filter 268 can be located within the vacuum source port 290.

In one arrangement, the method of using the vacuum sealing apparatus 230 is similar to the above-disclosed method of using the vacuum sealing apparatus 30. The difference between the two methods is primarily at the beginning of the vacuum sealing process. When using the vacuum sealing apparatus 230, the user first couples the connector 238 of the vacuum sealing apparatus 230 to the vacuum source port 290. In one arrangement, this coupling causes the vacuum source to begin operating. In other arrangements, the user can manually control the operation of the vacuum source. Either prior to or after the vacuum source begins operating, the user positions the inlet portion 232 in a container, such as a resealable bag, to be vacuum sealed. The user then uses the vacuum sealing apparatus 230 to remove the air from the container in a manner substantially similar to the method of using the vacuum sealing apparatus 30. To deactivate the vacuum source, the user can decouple the connector 238 from the vacuum source port 290 or use other available means for deactivation, such as a switch located on the vacuum sealing apparatus 230.

Figure 14:
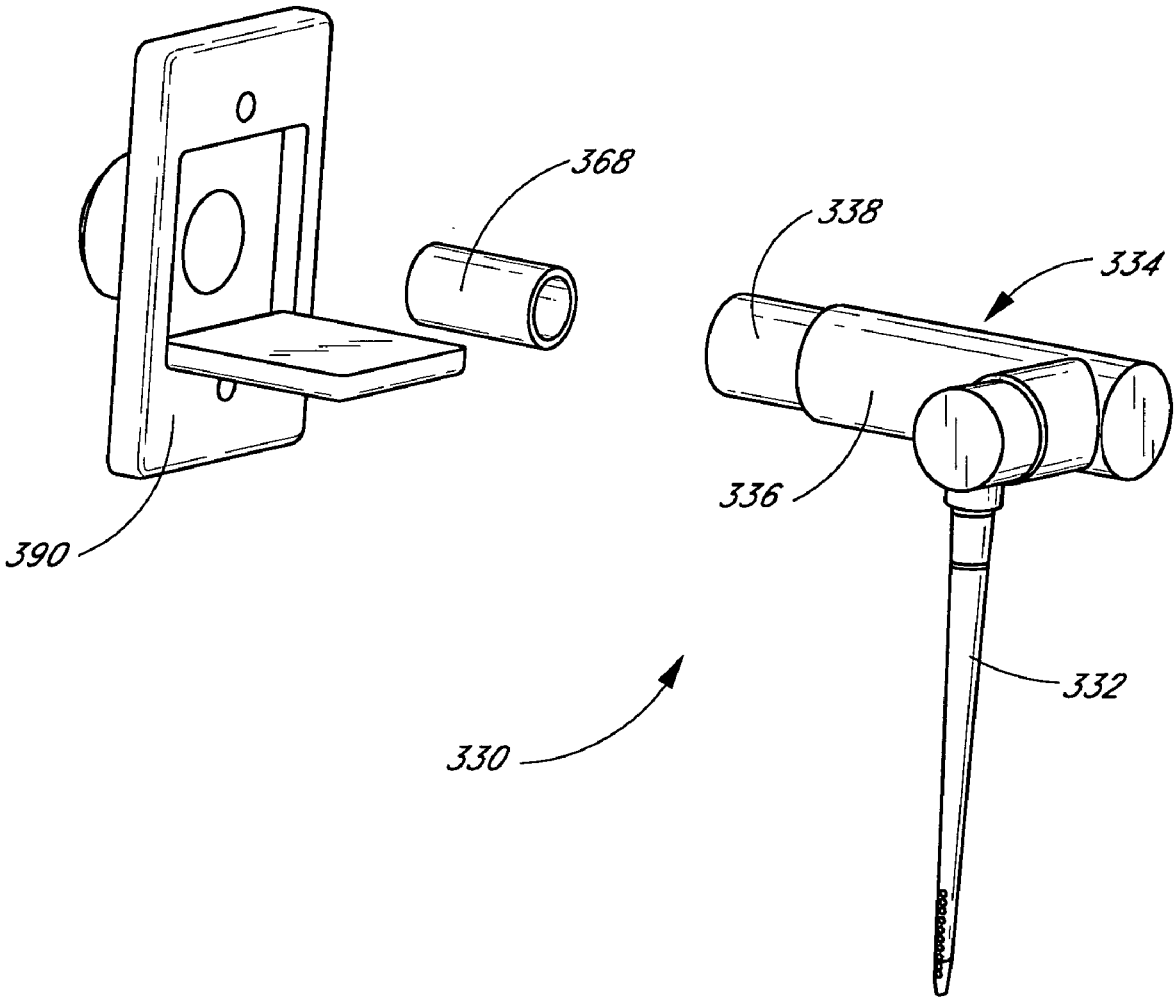
FIG. 14 is a perspective view of yet another vacuum sealing apparatus arranged and configured in accordance with certain features, aspects and advantages of the present invention.

With reference now to FIG. 14, an embodiment of a vacuum sealing apparatus 330 is illustrated that is arranged and configured in accordance with certain features, aspects and advantages of the present invention. Once again, to simplify the description, components will not be redescribed in detail if they were described above. Rather, the components in the embodiments of FIG. 14 will be given a reference numeral that retains the same last two digits as the reference numeral used in the embodiment of FIGS. 1–13, and the last two digits will be preceded with a numeral "3." Thus, the vacuum sealing apparatus 330 generally corresponds to the vacuum sealing apparatus 30, the vacuum sealing apparatus 130 and the vacuum sealing apparatus 230 with certain differences that will be illuminated in the following discussion.

As shown, the vacuum sealing apparatus 330 comprises an inlet portion 332 and an intermediate portion 334. The illustrated intermediate portion 334 further comprises a chamber body 336 and a connector 338. The chamber body 336 preferably comprises a tubular body made of a rigid material, such as for example, a plastic or light-weight metal.

Similar to the connector 238 of FIGS. 12 and 13, the connector 338 is preferably adapted to couple to a vacuum source port 390, such as the wall port 390 of an in-house vacuum system. In other arrangements, the connector 338 can be used with household vacuum cleaners, portable vacuum systems, vacuum pumps, fans and/or the like. In yet other configurations, the connector 338 can be customized to couple to various vacuum sources, or multiple connectors or adapters can be used in place of, or in combination with, the illustrated connector 338.

With reference to FIG. 14, the illustrated vacuum sealing apparatus 330 further comprises a filter 368. Similar to the filter 68 of the vacuum sealing apparatus 30, the filter 268 is preferably an inline contamination filter that substantially reduces or eliminates the flow of particles and/or liquid between the vacuum source and the vacuum sealing apparatus 330. Preferably, the filter 368 is removable so as to permit cleaning and/or replacement. Although the illustrated filter 368 is disposed within the connector 338, it is to be understood that the filter 368 can be disposed in any location within the vacuum sealing apparatus 330 that allows for the blocking of particles or liquids. In yet other arrangements, the filter 368 can be located within the vacuum source port 390.

In one arrangement, the method of using the vacuum sealing apparatus 330 is similar to the above-disclosed method of using the vacuum sealing apparatus 30. First, the user attaches the vacuum sealing apparatus 330 to the vacuum source port 390. When the inlet portion 332 is rotated into a substantially vertical position (as shown in FIG. 14), the in-house vacuum system begins drawing air through the inlet portion 332. The user then uses the vacuum sealing apparatus 330 to remove air from a container. To deactivate the vacuum source, the inlet portion 332 is rotated to a substantially horizontal orientation.

In another arrangements, attaching the vacuum sealing apparatus 330 to the vacuum source port 390 causes the vacuum source to begin operating, or the user can manually control the operation of the vacuum source. In yet another configuration, the vacuum sealing apparatus 330 can include a stop-cock valve, or the like, within the intermediate portion 334 that regulates the flow of air through the vacuum sealing apparatus 330. In such a configuration, when the vacuum source is turned on, rotating the inlet portion 332 downward opens the valve such that air is drawn in through the inlet portion 332, and rotating the inlet portion 332 upward closes the valve to decrease and/or stop air flow through the vacuum sealing apparatus 330.

Although the present invention has been disclosed in the context of certain preferred embodiments, examples and variations, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of any of the many embodiments may be made and still fall within the scope of the invention. It should be understood that various features and aspects of the disclosed embodiments can be combined with or substituted for one another in order to form varying modes of the disclosed invention. Moreover, some variations that have been described with respect to one embodiment and not another embodiment can be used with such other embodiments. Many variations have been described herein and cross-application is intended where physically possible. Thus, it is intended that the scope of the present invention herein disclosed should not be limited by the particular disclosed embodiments described above, but should be determined only by a fair reading of the claims that follow.

What is claimed is:

1. A device for use in vacuum sealing a resealable container using a central vacuum system, said device comprising:

a cover plate portion configured to attach to a wall port in communication with a central vacuum system;

an intermediate portion having an inlet port and an outlet port, the outlet port being in communication with said cover plate portion;

an elongated air inlet portion having a tubular end, a connector end and a lumen extending therethrough, wherein the connector end of said air inlet portion is pivotably attached to said intermediate portion, and wherein the lumen of said air inlet portion is in communication with said inlet port;

a contamination filter disposed in at least one of said cover plate portion, said intermediate portion and said air inlet portion; and an actuator coupled to the elongated air inlet portion between said tubular end and said intermediate portion and configured to actuate said actuator such that air is drawn in through said air inlet portion when the tubular end of said air inlet portion is moved in a substantially downward direction.

2. The device of claim 1, wherein said air inlet portion comprises a non-telescoping nozzle.

3. The device of claim 1, wherein said air inlet portion is removable with respect to said intermediate portion.

4. The device of claim 1 further comprising a removable access cap, whereby removal of the access cap provides a user access to a chamber within said intermediate section.

5. The device of claim 1, wherein said contamination filter is disposed within said air inlet portion.

6. The device of claim 1, wherein the intermediate portion further comprises a mounting portion configured to attach to a substantially planar surface.

7. The device of claim 1, wherein said central vacuum system comprises a central in-house vacuum system.

8. The device of claim 1, wherein said elongated air inlet portion comprises a plurality of air inlet holes proximate said tubular end.

9. The device of claim 1, wherein said elongated air inlet portion comprises an elongated body extending between said tubular end and said connector end, and wherein said movement of said tubular end comprises movement of said tubular end along an axis of the body of said air inlet portion.

10. An apparatus for use in vacuum sealing a resealable container, said apparatus comprising:

means for accessing an interior portion of a flexible, resealable container;

means for communicating with a wall port of a central vacuum system;

means for coupling said accessing means to said communicating means such that air is drawn through said accessing means when said central vacuum system is active;

means for substantially impeding contaminants from entering said central vacuum system through said accessing means and said communicating means, wherein said substantially impeding means is disposed in at least one of said accessing means, said communicating means and said coupling means; and means for activating said central vacuum system in response to a particular movement of said accessing means.

11. The apparatus of claim 10, wherein said particular movement of said accessing means is in a substantially downward direction.

12. The apparatus of claim 10, wherein said coupling means further comprises means for mounting said coupling means to a substantially planar surface.

13. The apparatus of claim 10, wherein said particular movement of said accessing means comprises rotation of said accessing means with respect to said coupling means.

14. The apparatus of claim 10, wherein said accessing means comprises a tubular end, and wherein said particular movement of said accessing means comprises movement of said tubular end.

15. An apparatus for use in vacuum sealing a resealable container using a central vacuum system, said device comprising:

a cover plate portion adapted to communicate with a central vacuum system;

an actuator configured to activate said central vacuum system;

an intermediate portion having an inlet port and an outlet port, said outlet port being in communication with said cover plate portion;

an air inlet portion comprising a tubular end, said air inlet portion being rotatably attached to said intermediate portion and operably coupled to said actuator such that said air inlet portion is adapted to actuate said actuator when the tubular end of said air inlet portion is moved in a substantially downward direction, wherein said actuator coupled to the air inlet portion between said tubular end and said intermediate portion; and a contamination filter disposed in at least one of said cover plate portion, said intermediate portion and said air inlet portion.

16. The apparatus of claim 15, wherein said actuator comprises an electrical switch.

17. The apparatus of claim 16, wherein said switch comprises a first contact portion and a second contact portion, and wherein said air inlet portion is adapted to cause an electrical connection between said first contact portion and said second contact portion when the tubular end of said air inlet portion is moved in said substantially downward direction.

18. The apparatus of claim 17, wherein said movement of said tubular portion comprises rotation of said air inlet portion in said substantially downward direction.

19. The apparatus of claim 17, wherein said air inlet portion comprises an elongated body coupled to said tubular end, and wherein said movement of said tubular end comprises movement of said tubular end along an axis of the body of said air inlet portion.

20. The apparatus of claim 15, wherein said central vacuum system comprises an in-house vacuum system, and wherein said cover plate portion is further adapted to communicate with a wall port of said in-house vacuum system.

* * * * *